US007780578B2

(12) United States Patent
Packham

(10) Patent No.: US 7,780,578 B2
(45) Date of Patent: Aug. 24, 2010

(54) MID-DECK HINGED FOLDABLE TREADMILL DECK

(76) Inventor: David Austin Packham, 2973 Holiday Ranch Loop Rd., Park City, UT (US) 84060

( * ) Notice: Subject to any disclaimer, the term of this patent is extended or adjusted under 35 U.S.C. 154(b) by 0 days.

(21) Appl. No.: 12/185,065

(22) Filed: Aug. 1, 2008

(65) Prior Publication Data

US 2009/0062072 A1 Mar. 5, 2009

Related U.S. Application Data

(63) Continuation of application No. 11/726,064, filed on Mar. 20, 2007, now abandoned.

(51) Int. Cl.
*A63B 22/02* (2006.01)

(52) U.S. Cl. ..... 482/54; 482/4; 482/51

(58) Field of Classification Search ..... 482/28, 482/54, 904, 908, 910; 108/11, 20–22, 39, 108/50.01, 91, 144.11, 145, 147.19, 180, 108/141, 138; 248/419
See application file for complete search history.

(56) References Cited

U.S. PATENT DOCUMENTS 4,654,756 A * 3/1987 Wilson et al. ..... 361/827
4,714,025 A * 12/1987 Wallin et al. ..... 108/20
5,163,885 A * 11/1992 Wanzer et al. ..... 482/54
5,259,326 A * 11/1993 Borgman et al. ..... 108/147
5,408,940 A * 4/1995 Winchell ..... 108/147
5,704,879 A * 1/1998 Watterson et al. ..... 482/54
5,743,833 A * 4/1998 Watterson et al. ..... 482/54
5,752,449 A * 5/1998 Simon et al. ..... 108/50.02
5,813,947 A * 9/1998 Densmore ..... 482/51
6,123,648 A 9/2000 Stevens
6,224,516 B1 * 5/2001 Disch ..... 482/54
6,286,441 B1 * 9/2001 Burdi et al. ..... 108/147
6,520,890 B2 * 2/2003 Hsu ..... 482/54
6,553,919 B1 * 4/2003 Nevin ..... 108/50.01
6,595,144 B1 * 7/2003 Doyle ..... 108/147
6,786,853 B2 * 9/2004 Wu et al. ..... 482/54
6,808,475 B2 * 10/2004 Kehrbaum ..... 482/54
6,830,540 B2 * 12/2004 Watterson et al. ..... 482/54
7,022,051 B2 * 4/2006 Ota ..... 482/54
7,029,079 B2 * 4/2006 Holt ..... 312/223.3
RE39,180 E * 7/2006 Colassi ..... 482/54
7,100,516 B2 * 9/2006 Riddiford et al. ..... 108/50.01
7,192,388 B2 * 3/2007 Dalebout et al. ..... 482/54
7,314,010 B2 * 1/2008 George et al. ..... 108/50.01
7,367,926 B2 * 5/2008 Clark ..... 482/54
2002/0103057 A1 * 8/2002 Watterson et al. ..... 482/54
2002/0124777 A1 * 9/2002 Lag ..... 108/20

(Continued)

*Primary Examiner*—Fenn C Mathew
*Assistant Examiner*—Andrew M Tecco
(74) *Attorney, Agent, or Firm*—Clayton, Howarth & Cannon, P.C.

(57) ABSTRACT

An exercise apparatus that is stowable in a containment space formed by an article of furniture. The exercise apparatus may be deployed from a storage position within the containment space to a ready-to-use position. An electronic console for the exercise apparatus may be deployed to a ready-to-use position for use in conjunction with the exercise apparatus. The electronic console may be placed into a storage position when the exercise apparatus is stowed in the containment space so as not to interfere with the normal use of the article of furniture. The article of furniture may further comprise a component that is moveable to reveal a grasping member for use in conjunction with the exercise device.

50 Claims, 10 Drawing Sheets

U.S. PATENT DOCUMENTS

2002/0151413 A1* 10/2002 Dalebout et al. ..... 482/54
2003/0033963 A1* 2/2003 Doyle ..... 108/147.19
2003/0216226 A1* 11/2003 Chen ..... 482/54
2004/0171464 A1* 9/2004 Ashby et al. ..... 482/54
2004/0176215 A1* 9/2004 Gramaccioni ..... 482/54
2005/0130807 A1* 6/2005 Cutler et al. ..... 482/54
2005/0202936 A1* 9/2005 Ota ..... 482/54
2005/0255969 A1* 11/2005 Smith et al. ..... 482/54
2006/0142124 A1* 6/2006 Lo ..... 482/54
2006/0247109 A1* 11/2006 Powell ..... 482/148
2007/0000414 A1* 1/2007 Riddiford et al. ..... 108/50.01
2007/0004561 A1* 1/2007 Yoo ..... 482/54
2007/0049464 A1* 3/2007 Chou ..... 482/54
2007/0167293 A1* 7/2007 Nally et al. ..... 482/54
2008/0084147 A1* 4/2008 Brown ..... 312/223.3
2009/0044735 A1* 2/2009 Nielsen ..... 108/147.19

* cited by examiner

MID-DECK HINGED FOLDABLE TREADMILL DECK

CROSS-REFERENCE TO RELATED APPLICATIONS

This application is a continuation-in-part of co-pending U.S. patent application Ser. No. 11/726,064, filed Mar. 20, 2007, entitled "MID-DECK HINGED TREADMILL DECK" which is hereby incorporated by reference herein in its entirety, including but not limited to those portions that specifically appear hereinafter, the incorporation by reference being made with the following exception: In the event that any portion of the above-referenced application is inconsistent with this application, this application supercedes said above-referenced application.

STATEMENT REGARDING FEDERALLY SPONSORED RESEARCH OR DEVELOPMENT

Not Applicable.

BACKGROUND

1. The Field of the Invention

The present disclosure relates generally to exercise equipment, and more particularly, but not necessarily entirely, to exercise equipment that may be incorporated into, or used in conjunction with, articles of furniture and other structures.

2. Description of Related Art

With the increased attention given to health awareness, the proliferation of exercise equipment has expanded to both residential and office settings. One popular type of exercise equipment is an exercise treadmill, or treadmill. A treadmill typically comprises an endless belt trained around a pair of rollers that allows a person to walk or jog while remaining in the same position. An electric motor of variable speed may be utilized to move the belt around the rollers. An electronic console may be used with the treadmill to provide information about a workout and to monitor a status of a user while exercising. For example, the electronic console may provide, among other things, information on pre-programmed exercise routines, the time spent exercising, the number of calories burned, the heart rate information, as well as the distance traveled.

One drawback to the use of previously available exercise equipment is the difficulty in storing the exercise equipment when not in use. In particular, exercise equipment tends to have a relatively large footprint, especially for the confined spaces of some homes and offices. Further, as exercise equipment is typically used for only a short duration in any given day, the relatively large area needed to store the equipment may not be justified in the eyes of some consumers.

Some attempts have been made in the past in an attempt to limit the storage space required for exercise equipment. For example, U.S. Pat. No. 6,123,648 (granted Sep. 26, 2000 to Stevens) discloses a treadmill having a deck that may be stored in a vertical orientation. U.S. Pat. No. 6,830,540 (granted Dec. 14, 2004 to Watterson et al.) discloses a treadmill having deck whose front and rear portions can be folded together to thereby decrease the overall length of the treadmill. U.S. Pat. No. 6,808,475 (granted Oct. 26, 2004 to Kehrbaum) discloses a computer workstation with a treadmill. U.S. Pat. No. 6,224,516 (granted May 1, 2001) discloses an article of furniture with a treadmill exercising device. U.S. Pat. No. 5,813,947 (granted Sep. 29, 1998) discloses an exercise apparatus with a desk that enables a user to exercise on an exercise device while carrying out unrelated activities. U.S. Pat. No. 5,743,833 (granted Apr. 28, 1998) discloses a treadmill that is storable in a cabinet enclosure.

While the above disclosed devices have, in some instances, made improvements towards reducing the storage space required for exercise devices, improvements are still being sought. For example, many of the devices that combine an exercise apparatus with a common article of furniture lack features typically found on a stand-alone version of the same exercise apparatus, such as electronic consoles and ergonomic handles. It would be a further improvement to the state of the art provide a combined article of furniture and exercise apparatus where the components necessary for use of the exercise apparatus do not interfere with the normal use of the article of furniture when the exercise apparatus is not in use. It would be a further improvement to the state of the art to provide a treadmill with an improved folding mechanism for the treadmill deck.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
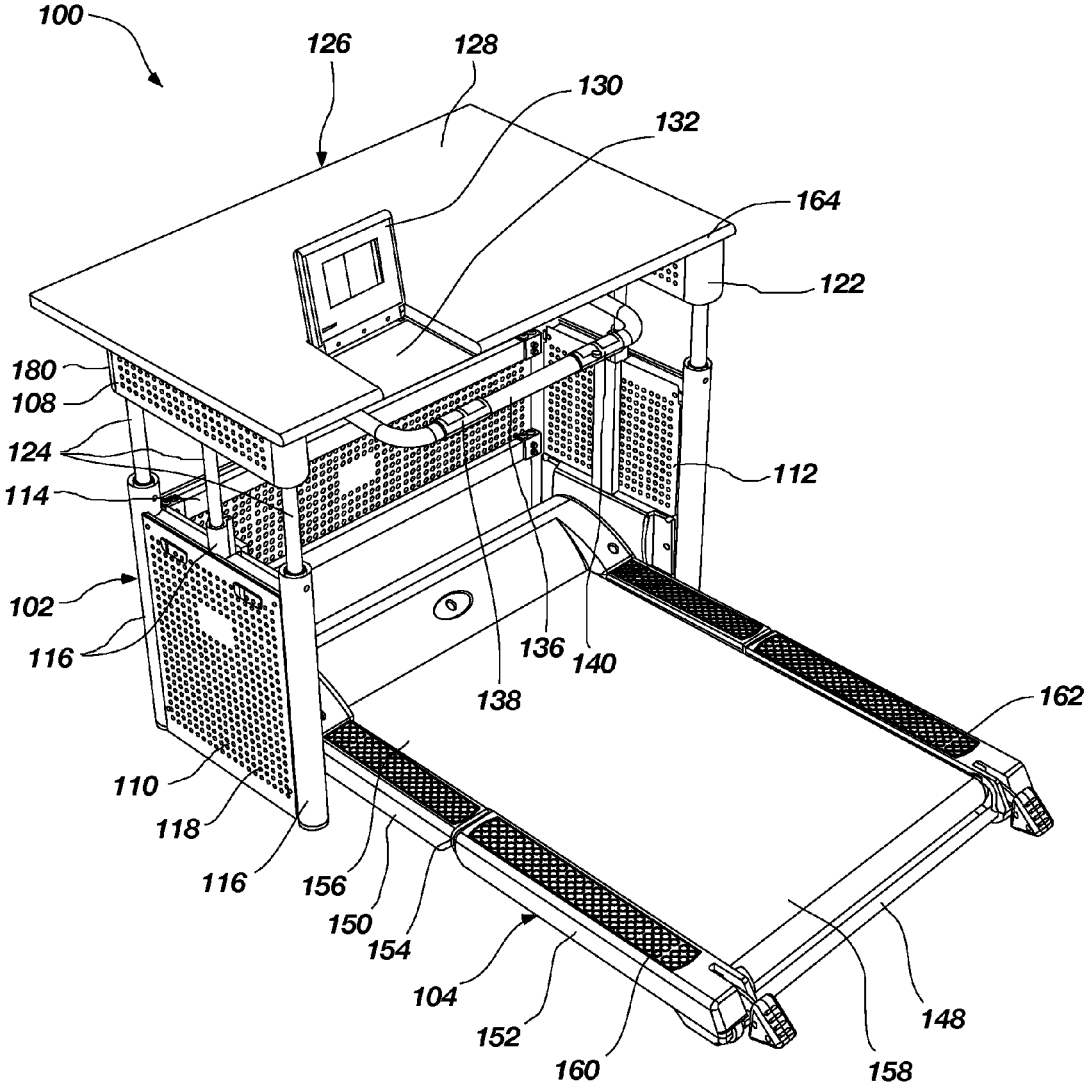
FIG. 1 is a perspective view of an exercise apparatus according to an embodiment of the present disclosure in a ready-to-use position.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise. In describing and claiming the present disclosure, the following terminology will be used in accordance with the definitions set out below. As used herein, the terms "comprising," "including," "containing," "characterized by," "having," and grammatical equivalents thereof are inclusive or open-ended terms that do not exclude additional, unrecited elements or method steps.

Applicant has discovered a treadmill device having a front portion and a rear portion joined together by a hinge. The hinge allows the front portion and the rear portion to be folded together to thereby reduce the required storage space for the treadmill device. The treadmill device further includes a release mechanism for the treadmill belt's rear roller. In particular, the release mechanism unlocks the rear roller from its operating position to thereby release the tension in the belt. The release of the tension in the belt enables the front portion and the rear portion of the treadmill device to be more easily folded together.

The applicant's treadmill device may be used in conjunction with an article of furniture, such as a desk. The article of furniture may comprise a containment area for storing the folded-up treadmill device such that the article of furniture may be used in its normal manner without interference from the treadmill device. The article of furniture itself may have incorporated therein features suitable for use with the exercise apparatus, such as a grasping member and an electronic console. Both the grasping member and the electronic console may be re-positioned or concealed so as not to interfere with normal usage of the article of furniture when the treadmill device is not being used. It will be further appreciated that the applicant's treadmill device may also be used in conjunction with any other suitable structure.

Referring now to FIG. 1, there is generally shown an exercise apparatus 100 pursuant to an embodiment of the present disclosure. The apparatus 100 may comprise a desk portion 102 and a treadmill portion 104. The desk portion 102 may comprise a lower support structure 106 and an upper support structure 108. The lower support structure 106 may comprise a left sidewall 110 and a right sidewall 112. A rear wall 114 may extend between the left sidewall 110 and the right sidewall 112 to thereby bound a containment space on three sides. The left sidewall 110 may comprise three-spaced apart posts 116 that extend vertically from the ground. A panel 118 may be attached to the posts 116. It will be appreciated that the right sidewall 112 may be similarly configured as the left sidewall 110.

The upper support structure 108 may comprise a left sidewall 120 and a right sidewall 122. Extending downwardly from the left sidewall 120 may be three-spaced apart posts 124 that correspond positionally to posts 116 of the left sidewall 120 of the lower support structure 106. Posts 124 may be configured and adapted to be received into an interior portion of posts 116 such that posts 124 may be raised and lowered in a telescoping arrangement. In an embodiment of the present disclosure, at least one electric motor may be utilized to raise and lower the upper support structure 108 as will be explained hereinafter.

Disposed on a top of the left sidewall 120 and the right sidewall 122 of the upper support structure 108 may be a desk desktop 126. An uppermost surface 128 of the desktop 126 may form a work surface. In an embodiment of the present disclosure, the uppermost surface 128 may be substantially rectangular in shape. The vertical height of the upper support structure 108 may be varied with respect to the lower support structure 106 by extending and retracting the posts 124 into and out of posts 116. As will be explained in more detail hereinafter, this variable height adjustment feature may allow the apparatus 100 to be used as a sitting desk, a standing desk, and as an exercise apparatus.

Figure 2:
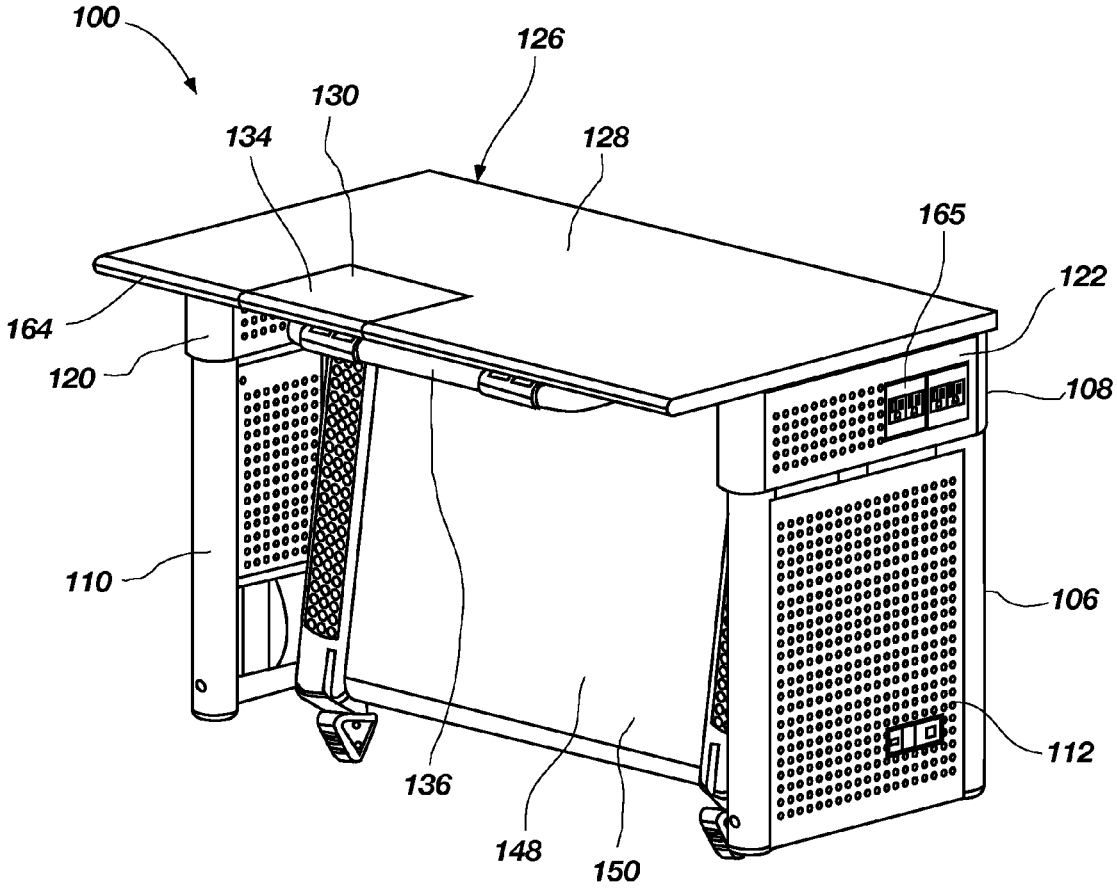
FIG. 2 is a perspective view of the exercise apparatus shown in FIG. 1 in a storage position.

An electronic console 130 may be pivotally mounted in a recess 132 in the desktop 126. The recess 132 may take substantially the same size and shape of the electronic console 130. As will be explained hereinafter, the electronic console 130 may be utilized in conjunction with the treadmill portion 104 of the apparatus 100. The electronic console 130 may be operable between a ready-to-use position, as shown in FIG. 1, and a storage position, as shown in FIG. 2. In the ready-to-use position, a face of the electronic console 130 is visible to a user using the treadmill portion 104 of the apparatus 100 and the electronic console 130 extends above the uppermost surface 128 of the desktop 126. As seen in FIG. 2, in the storage position, the face of the electronic console 130 is pivotally rotated out of view such that a rear surface 134 of the electronic console 130 is substantially flush with the uppermost surface 128 of the desktop 126. In an embodiment of the present disclosure, the rear surface 134 is slightly raised and textured to serve as a mouse pad. It will be appreciated that the electronic console 130 may be able to "flip-up" when the treadmill portion 104 is in use and "flipped-down" when the desk portion 102 is in use.

As seen in FIG. 2, when the electronic console 130 is in the storage position, the rear surface 134 of the console 130 may serve as a work surface for the desk portion 102 of the apparatus 100. The work surface provided by the rear surface 134 of the electronic console 130 may be a work surface in addition to the work surface provided by the uppermost surface 128 of the desktop 126.

Referring now back to FIG. 1, extending from a location underneath the desktop 126 may be a grasping member 136 for use with the treadmill portion 104 of the apparatus 100. In particular, the grasping member 136 may be utilized to stabilize a user walking or running on the treadmill portion 104 of the apparatus 100. The grasping member 136 may not be used in conjunction with the desk portion 102 of the apparatus 100. In an embodiment of the present disclosure, the grasping member 136 may be formed from a tubular material and include a left grip 138 and a right grip 140. Incorporated into one, or both, of the left grip 138 and the right grip 140 of the grasping member 136 may by a pulse rate sensor as is known to one having ordinary skill in the art. In addition, a magnetically operated stop switch may also be incorporated into the grasping member 136, which may receive a magnet on the end of a lanyard that is attached with a clip to a user.

The height of the grasping member 136 may be adjusted by varying the height of the upper support structure 108 in the manner as previously described. However, the grasping member 136 may be coupled directly to the upper support structure 108 and not to the desktop 126 itself for reasons that will be stated hereinafter. It will be further appreciated that the ability to vary the height of the grasping member 136 may accommodate users of different heights that may exercise on the treadmill portion 104.

The treadmill portion 104 of the apparatus 100 may comprise a deck member 148 having a front portion 150 and a rear portion 152 joined by a hinge 154 such that the front portion 150 and the rear portion 152 may pivot with respect to one another. A belt 158 may be mounted to the deck member 148. Disposed on either side of the belt 158 may be foot rails 160 and 162. In an embodiment of the present disclosure, the belt 158 is about 30 inches wide. The width of the deck member 148 may be sufficiently wide to accommodate the belt 158 at 30 inches wide.

As can be observed in FIG. 1, the deck member 148 may be extended from the containment space formed by the left sidewall 110, the right sidewall 112, and the rear wall 114 of the deck portion 102 in a ready-to-use position. In the ready-to-use position, a user is able to exercise using the treadmill portion 104 of the apparatus 100. In particular, a user may be able to operate a drive motor for the belt 158 using the electronic console 130 to thereby rotate the belt 158. In addition, a user may be able to grip the grasping member 136 with one or both hands to thereby maintain his or her balance while exercising.

As mentioned, the electronic console 130 may control the operation of the belt 158. In particular, the electronic console 130 may include a display, such as an LCD display, for conveying information to a user. In addition, the electronic console 130 may allow the user to select between different exercise options and information to be displayed. In an embodiment of the present disclosure, the electronic console 130 may display the distance traveled, the duration of the exercise session, the number calories burned, heart rate information, and the number of steps traveled. The electronic console 130 may display information in a countdown mode. For example, the electronic console 130 may countdown the time left to exercise, the distance left, the number of steps left, and the number of calories left to burn.

In an embodiment of the present disclosure, the electronic console 130 may comprise a display module for displaying information to a user, a processor module operable between different modes of operation, and at least one manual actuator for selecting between the different modes of operation, where at least one of the modes of operation causes the display module to display a countdown of a quantifiable exercise characteristic. The quantifiable exercise characteristic may be selected from the group consisting of distance, time, calories burned, and steps taken.

It will be appreciated that many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like which may now be available or which may become available in the future.

Modules may also be implemented in software code, sometimes referred to as computer readable instructions, for execution by various types of processors. An identified module of executable code may, for instance, comprise one or more physical or logical blocks of computer instructions that may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Referring now to FIG. 2, there is depicted the apparatus 100 configured as an article of furniture, such as a desk, with the deck member 148 of the treadmill portion 104 stored in the containment space formed by the left sidewall 110, the right sidewall 112, and the rear wall 114 (not visible) of the lower support structure 106. In particular, the front portion 150 and the rear portion 152 (not visible) of the deck member 148 have been folded together along the hinge 154 (not visible). In this configuration, the electronic console 130 may be flipped down such that it will not interfere with the use of the desk portion 102 of the apparatus 100. Further, the upper support structure 108 may be lowered to abut against the lower support structure 106, such that the uppermost surface 128 of the desktop 126 is at a convenient height for use by a user seated in a chair in front of the apparatus 100.

It will be further noted that the desktop 126 has been slid forward with respect to the upper support structure 108 to make the grasping member 136 less accessible since the grasping member 136 is not needed for use with the desk portion 102 of the apparatus 100. In this regard, the desktop 126 may be mounted on a track with respect to the upper support structure 108. The track may allow the desktop 126 to be laterally operable between a first position and a second position. The first position of the desktop 126, shown in FIGS. 1 and 3, may make the grasping member 136 accessible for use by a user for the treadmill portion 104. The second position of the desktop 126, shown in FIG. 2, makes the grasping member less accessible. In the second position, a front edge 164 of the desktop 126 may extend over the grasping member 136, while in the first position, the front edge 164 of the desktop 126, is not over the grasping member 136. It will be appreciated that the grasping member 136 need not be concealed from view or completely inaccessible while in the desktop 126 is in the second position. It will be further noted that the uppermost surface 128 of the desktop 126 may be substantially horizontal in both the first position and the second position so that items, such as a desktop computer, need not be removed from the desktop 126 in order to use the grasping member 136.

A first set of tracks for moving the desktop 126 may be mounted on top of the left sidewall 120 and the right sidewall 122 of the upper support structure 108 at corresponding positions. A second set of tracks may be mounted underneath the desktop 126. The second set of tracks may slidable engage the first set of tracks. The first and second set of tracks may comprise ball bearings to facilitate the sliding of the desktop 126 between the first position and the second position. It will be appreciated that other mechanisms for facilitating the movement of the desktop 126 between the first and second positions may be utilized with the present invention. It will be further appreciated that a locking mechanism with a release lever may be utilized to lock the desktop 126 in either of the first and second positions.

It will further be appreciated that because the uppermost surface 128 of the desktop 126 may remain horizontal in both the first and second positions, that items placed on the surface 128, such as a computer, will not need to be removed when the treadmill portion 104 of the apparatus 100 is being used. In particular, the user simply engages the release lever for the locking mechanism and slides the desktop 126 rearwards to make the grasping member 136 more accessible. The user may then flip-up the electronic console 130 to control the motor for the belt 158 and to control the height of the grasping member 136. When the workout is completed, the user may slide the desktop 126 forwards to render the grasping member 136 less accessible. The user may also lower the desktop 126 to a height suitable for use by a user sitting in a chair and then flip down the electronic console 130. In this manner, the grasping member 136 and the electronic console 130 will not interfere with use of the desk portion 102 of the apparatus 100. For additional convenience, the right sidewall 122 of the upper support structure 108 may include electrical outlets 165 for distributing power to any electronic devices, such as a desktop computer, placed on the desktop 126. The outlets 165 allow the height of the desktop 126 to be varied without being constrained by the power cords of electrical devices on the desktop 126.

Figure 3:
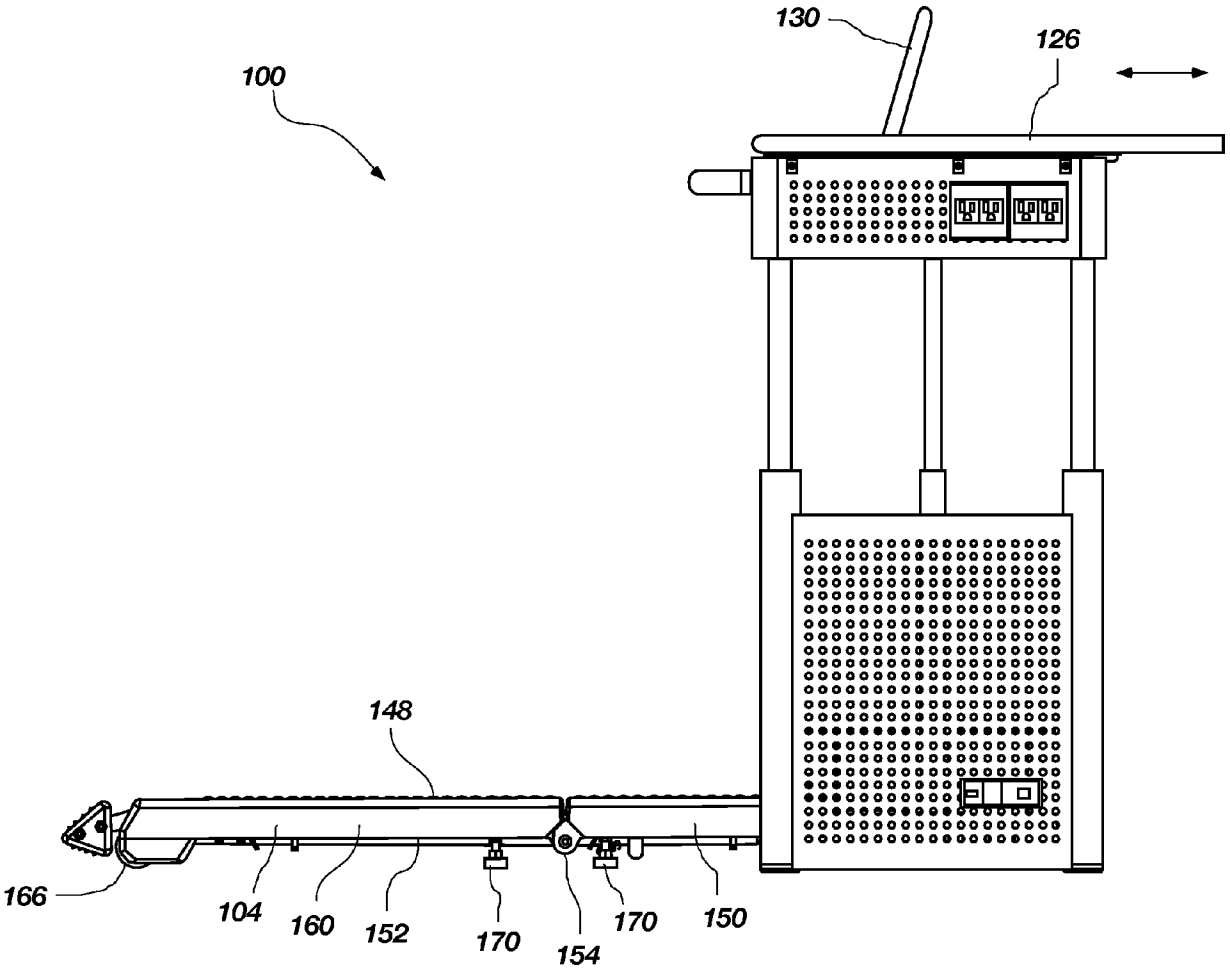
FIG. 3 is a side view of the exercise apparatus shown in FIG. 1 in a ready-to-use position.

Referring now to FIG. 3, there is depicted a side view of the apparatus 100 configured for use as exercise equipment. In particular, it will be noted that the desktop 126 is in the first position such that the grasping member 136 is accessible for use by a user on the treadmill portion 104. A pair of legs 170 with rubber feet may support the front portion 150 and the rear portion 152 of the deck member 148 near the hinge 154. A support wheel 166 may support the free end of the rear portion 152.

Figure 4A:
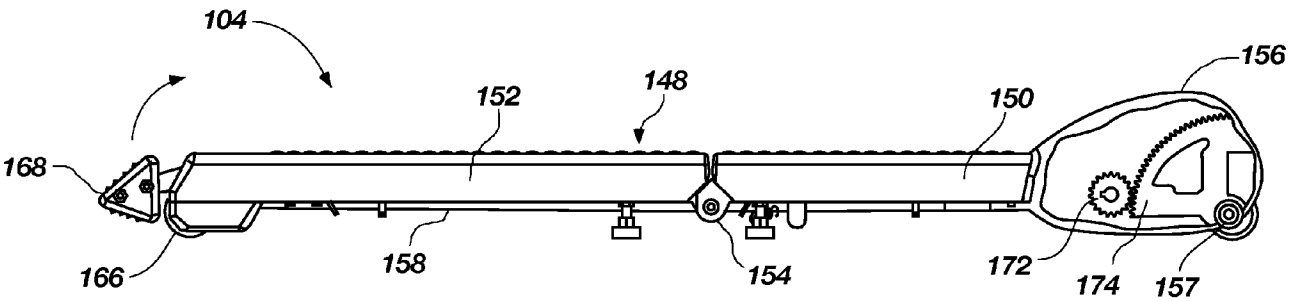
FIGS. 4A and 4B are side views of a treadmill portion of the exercise apparatus with a cut away view of the motor housing.
Figure 4B:
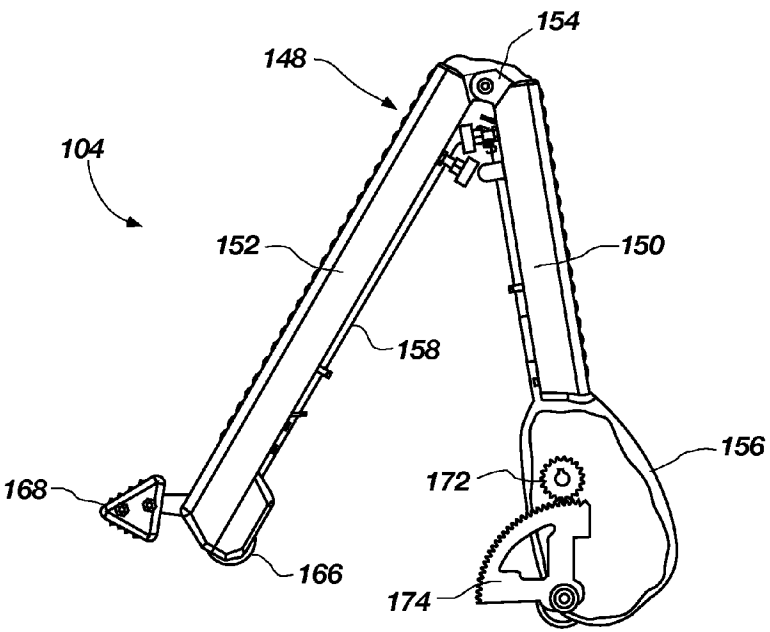

Referring now to FIGS. 4A and 4B, there is shown the treadmill portion 104 of the apparatus 100 in isolation from the desk portion 102 in the ready-to-use position and the storage position, respectively, with a cut-away view of the housing 156. In the ready-to-use position as shown in FIG. 4A, the front portion 150 and the rear portion 152 are at approximately 180 degrees from each other. In the storage position, as shown in FIG. 4B, the front portion 150 and the rear portion 152 form an acute angle with each other.

The treadmill portion 104 may be deployed without the desk portion 102 in an embodiment of the present disclosure. For example, the treadmill portion 104 may be deployed with another article of furniture other than a desk, as a stand-alone unit, or otherwise attached to a suitable structure. As previously discussed, the front portion 150 and the rear portion 152 of the deck member 148 may be pivotally joined along a hinge 154. The end of the front portion 150 opposite the hinge 154 may pivot around a rod 157. The end of the rear portion 152 opposite the hinge 154 may include the support wheel 166.

Figure 6:
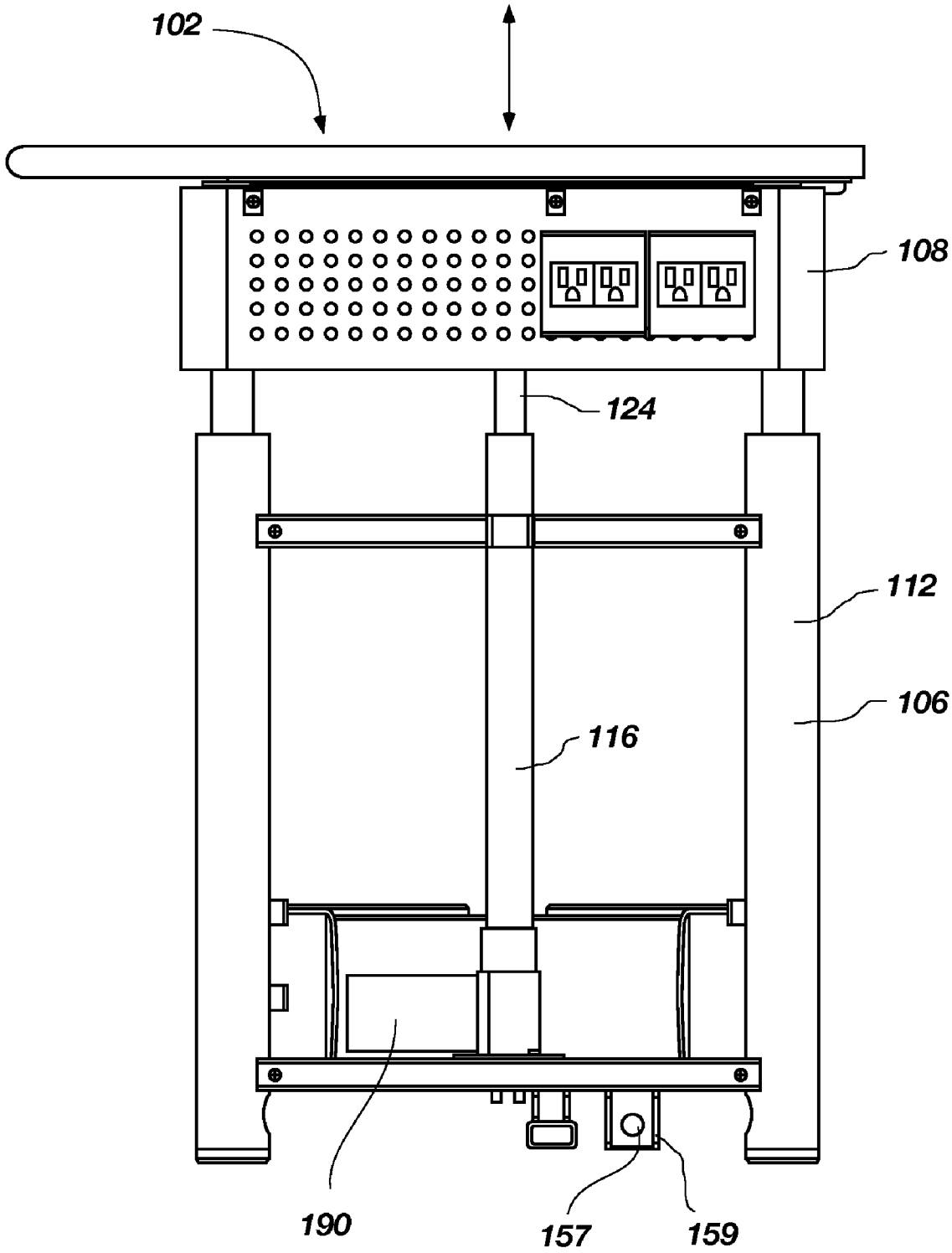
FIG. 6 is a side view of a lower support structure and upper support structure.

In order to convert the treadmill portion 104 from the ready-to-use position and the storage position, as shown in FIGS. 4A and 4B, respectively, a gear wheel 172 may be driven by, and mounted to an output shaft of a motor, not shown. The gear wheel 172 may engage a gear 174. The gear 172 may be fixed to the rod 157, which in turn may be fixed to the desk portion 102 by a bracket 159 such that it cannot rotate as shown in FIG. 6. Referring back to FIGS. 4A and 4B, as the gear wheel 172 rotates and "climbs" the gear 174, the front portion 150 may be raised from a horizontal position to an almost vertical position. Further, as the front portion 150 is raised, the rear portion 152 may be raised but pivots at hinge 154 under the force of gravity such that the front portion 150 and the rear portion 152 may fold together. A contact switch 173 may be located at the top of the gear 174 and the bottom of the gear 174. The contact switches 173 are actuated by the gear wheel 172 when the deck member 148 is at the fully raised or fully deployed. The contact switches 173 are operable to stop the motor 194 (see FIG. 7) driving the gear wheel 172 to prevent damage to the motor 194.

The free end of the rear portion 152 opposite the hinge 154 may also include a release mechanism 168 for releasing the tension in the belt 158. In particular, as the deck member 148 is moved from the ready-to-use position shown in FIG. 4A to the storage position shown in FIG. 4B, the tension in the belt 158 may be released to facilitate the conversion between the two positions. In particular, with the belt 158 taught, the front portion 150 and the rear portion 152 of the deck member 148 may not fold together as desired, but, with the belt 158 released from tension, the front portion 150 and the rear portion 152 may fold together easily.

Figure 5A:
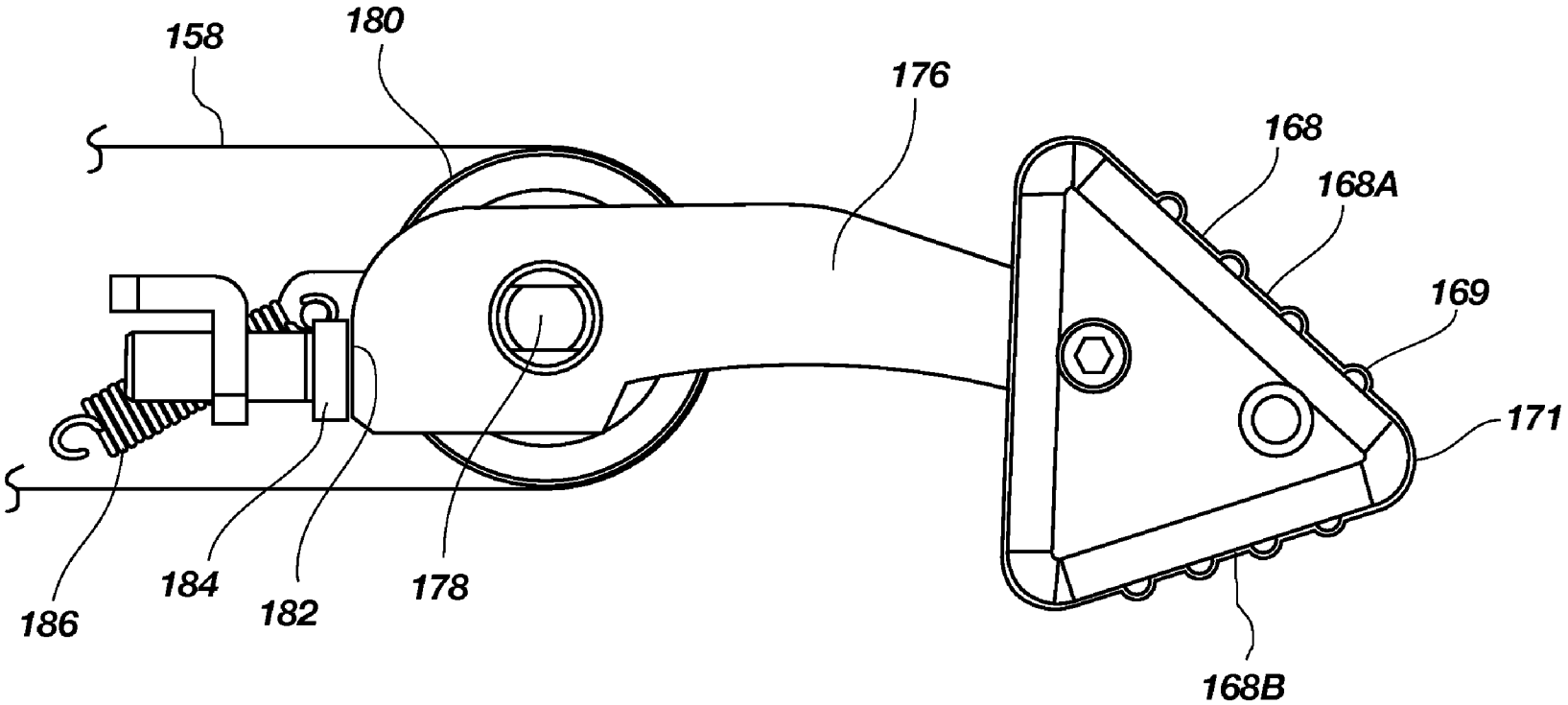
FIG. 5A is a side view of a release mechanism in a locked position.
Figure 5B:
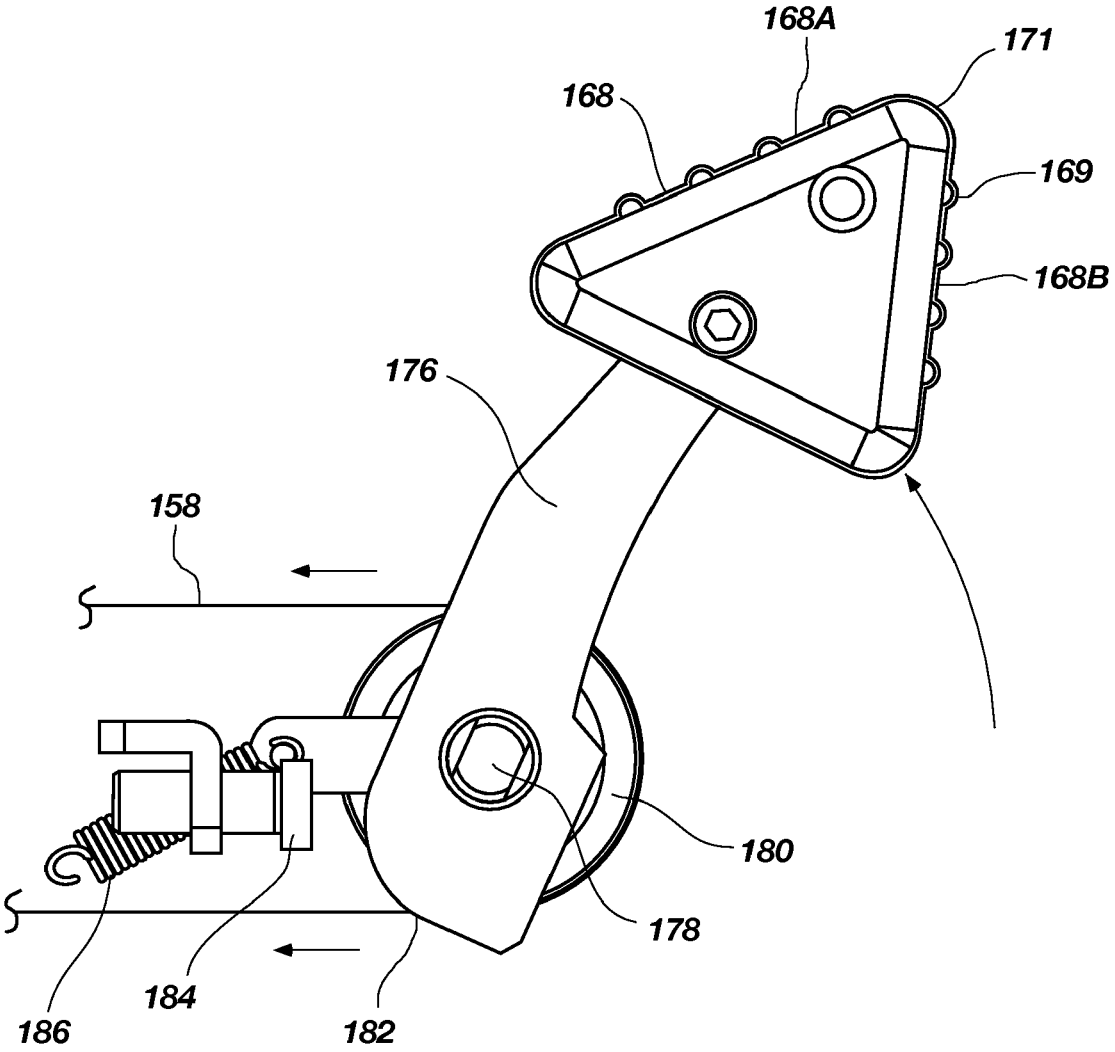
FIG. 5B is a side view of the release mechanism shown in FIG. 5A in a release position.

FIGS. 5A and 5B depict the operation of the release mechanism 168 for releasing tension in the belt 158 in a locked position and a release position, respectively. The release mechanism 168 may comprise a first surface 168A and a second surface 168B, each having a plurality of projections 169 disposed thereon. The first surface 168A and the second surface 168B may intersect along a common edge 171 to thereby form a wedge shape. In the locked position, as shown in FIG. 5A, the second surface 168B may slope upwardly from front to back. It will be appreciated that this allows the release mechanism 168 to be operated by foot. In particular, a user is able to slide his toe under the release mechanism 168 and provide an upward force to the second surface 168B to move the release mechanism 168 from the locked position to the release position. In the released position, as shown in FIG. 5B, a user may position the underside of his foot to thereby exert a downward force on the surface 168A to thereby move the release mechanism 168 from the release position to the locked position.

The release mechanism 168 may include a lever portion 176 pivotally mounted on a shaft 178 on which a rear roller 180 for the belt 158 rotates. The lever portion 176 may include a cam portion 182 for selectively engaging a stop 184. The stop 184 may be fixedly secured to the deck member 148. When the release mechanism 168 is in the locked position as shown in FIG. 5A, the cam portion 182 engages the stop 184 to thereby maintain tension in the belt 158. When the release mechanism 168 is operated to the release position as shown in FIG. 5B, the cam portion 182 disengages the stop 184 to thereby permit the shaft 178 and the rear roller 180 to slide forward as shown by the arrows in FIG. 5B. A resilient member 186 having one end coupled to the shaft 178 and the other to the deck member 148 may maintain the release mechanism 168 in the locked and release positions by biasing the cam portion 182 against the stop 184.

Referring now to FIG. 6, there is shown a side view of the desk portion 102, with an electric motor 190 in the right sidewall 112 of the lower support structure 106 for raising and lowering the upper support structure 108 exposed. It will be appreciated that a similar motor may be found in the left sidewall 110. For purposes of convenience, some of the structure that would otherwise obscure the view of the motor 190 has been removed. The motor 190 is operable to extend the middle post 124 of the upper support structure 108 out of the middle post 116 of the lower support structure 106, which in turn raises the entire upper support structure 108 in conjunction with the other motor in the left sidewall 110. The motor 190, as well as the other motor in the left sidewall 110, may be controlled by the console 130 to thereby raise and lower the upper support structure 108 as desired. In an embodiment of the present disclosure, the motor 190 may be capable of micro-adjust the height of the upper support structure 108.

Figure 7:
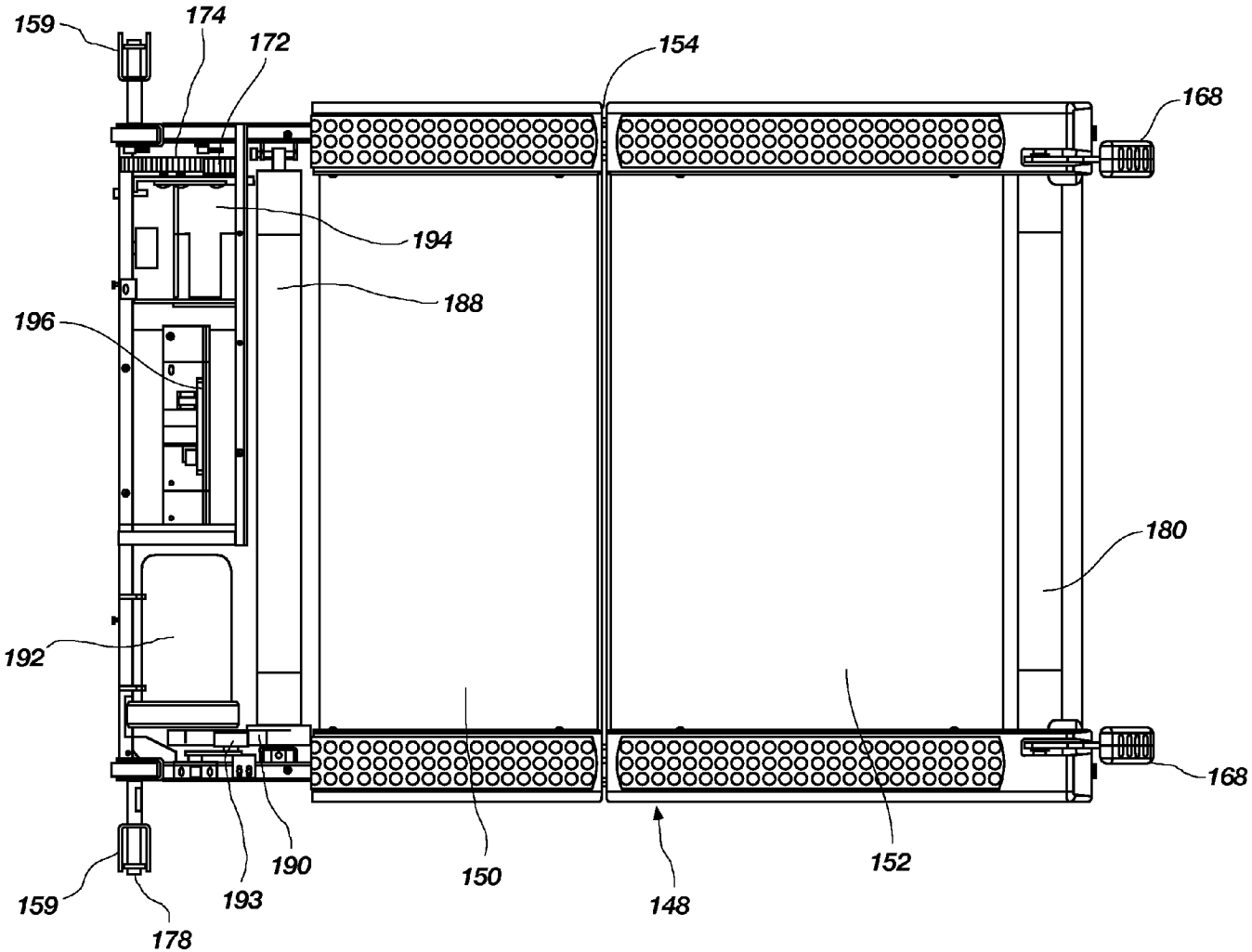
FIG. 7 is a top view of a treadmill portion with the motor housing top cover removed.

Referring now to FIG. 7, there is depicted a top view of the treadmill portion 104 with the housing 156 and the belt 158 removed for purposes of convenience in describing the components of the treadmill portion. As previously explained, the treadmill portion 104 includes a deck member 148 having a front portion 150 and a rear portion 152 jointed together at a hinge 154. The rear roller 180 and a front roller 188 allow the belt 158 to move freely around the deck member 148. A release member 168 may allow tension in the belt 158 to be released as previously discussed such that the deck member 148 may be operated between a storage position and a ready-to-use position.

The front roller 188 may be driven by a belt 190 attached to a shaft of a variable speed electric motor 192. An idler puller 193 may keep tension in the belt 190. The gear wheel 172 may be mounted on a shaft of the electric motor 194 for lifting the front portion 150 of the deck member 148 from a horizontal position to a nearly vertical position. The gear 174 is fixedly coupled to a shaft 178 that is secured to the desk portion 102 of the apparatus 100 by brackets 159 as shown in FIG. 6. Motor control circuitry 196 may also be located in the housing 156. The circuitry 196 may receive communications from the electronic console 130 to operate the treadmill portion 104, including commands to vary the speed of motor 192 and to operate motor 194.

Figure 8:
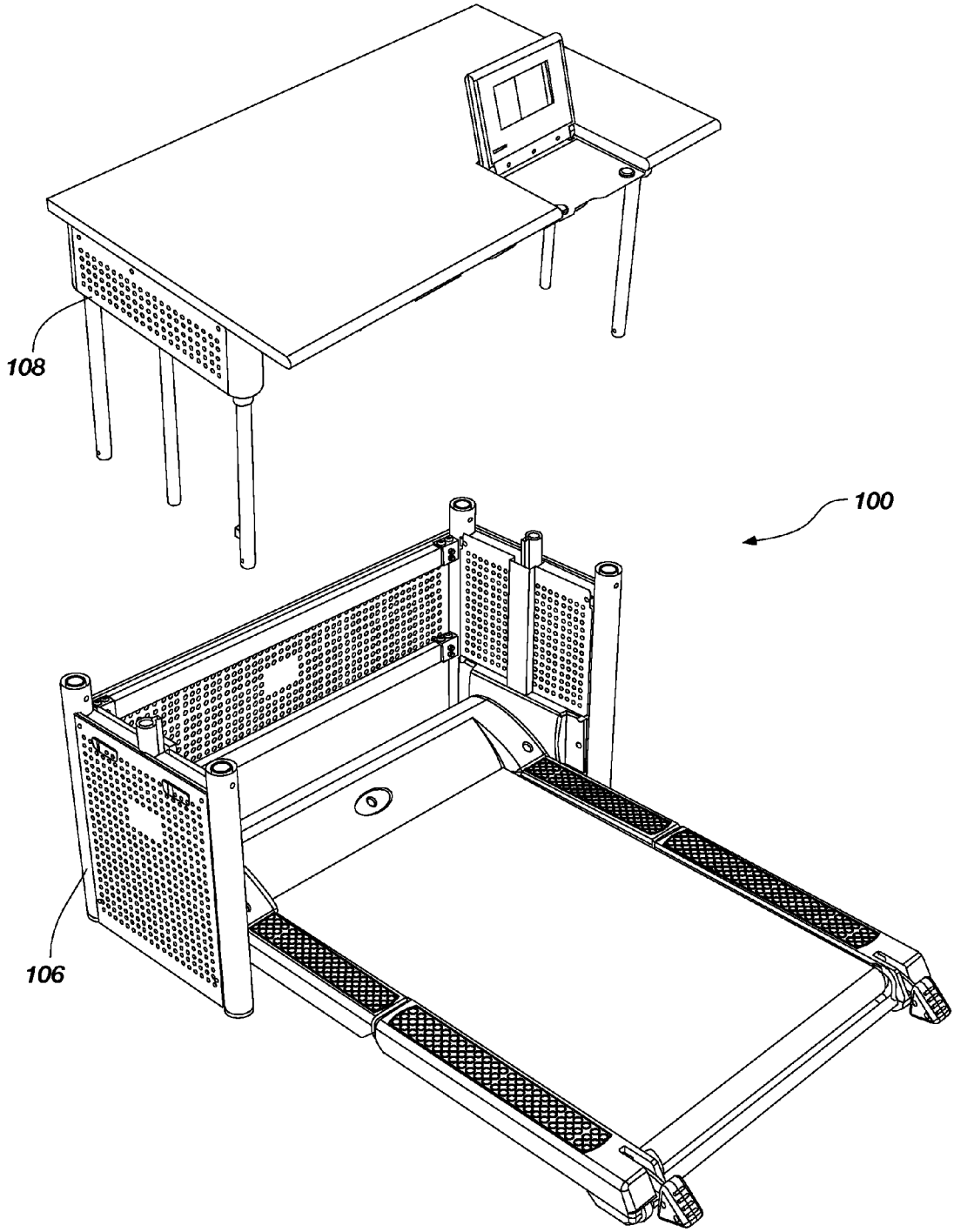
FIG. 8 is a partially exploded view of a lower support structure and an upper support structure.
Figure 9:
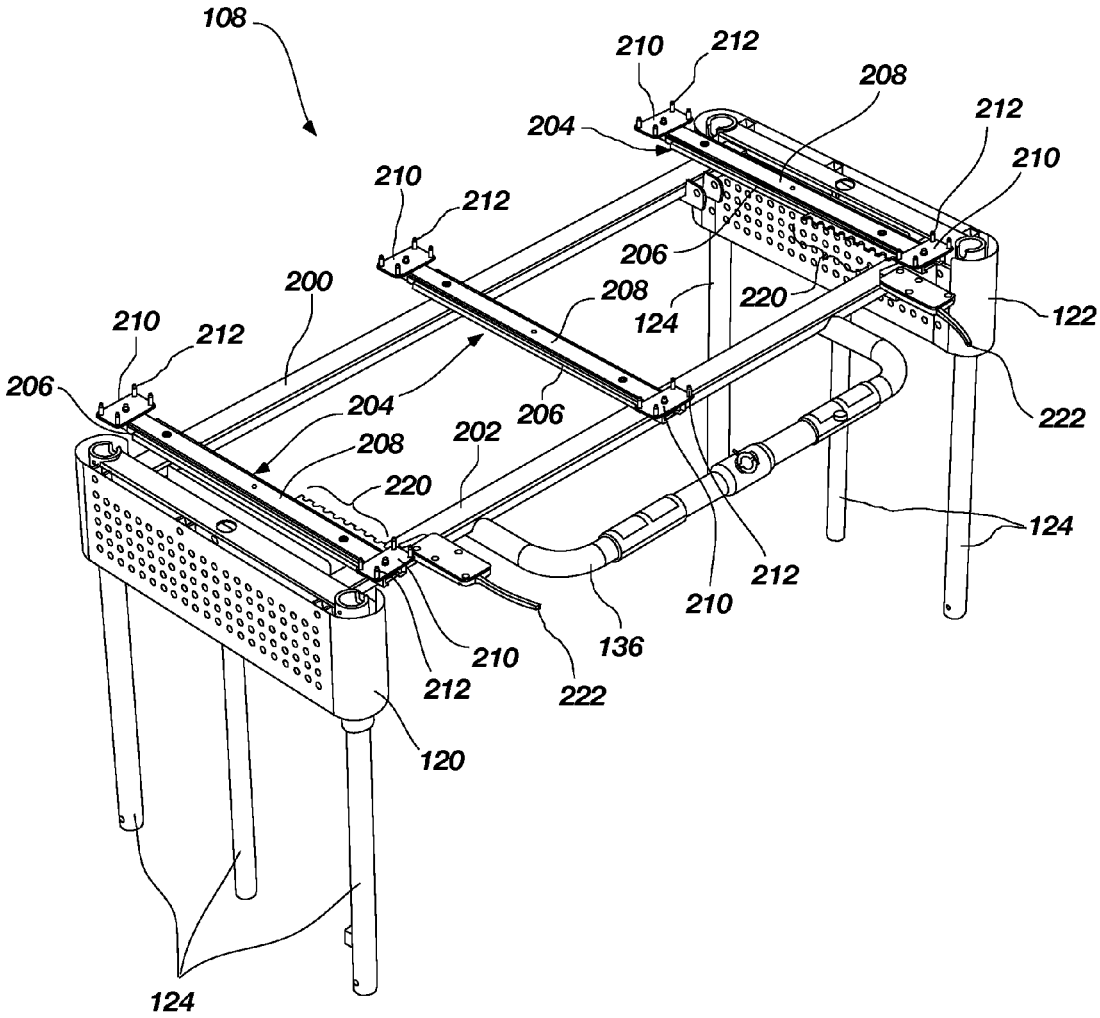
FIG. 9 is an isometric view of an uppers support structure with the desktop removed.

Referring now to FIG. 8, there is depicted a partially exploded view of the lower support structure 106 and the upper support structure 108 of the exercise apparatus 100. Referring now to FIG. 9, there is shown the upper support structure 108 without the desktop 129. Extending between the left sidewall 120 and the right side wall 122 are cross members 200 and 202. Mounted to, and extending between, the cross members 200 and 202 are track assemblies 204. Each track assembly 204 may comprise a lower track 206 that is secured to the cross members 200 and 202. Each track assembly 204 may further include an upper track 208 that slidably engages the lower track 206. At each end of the upper tracks 208 are coupling devices 210 for attaching the upper tracks 208 to the bottom side of desktop 126. The coupling devices 210 may include threaded fasteners 212 for engaging the desktop 126. The track assemblies 204 allow the desktop 126 to move forward and rearward in order to make the grasping member 136 more or less accessible as desired.

The grasping member 136 is coupled to the cross member 202 such that it does not move in conjunction with the desktop 126. Extending downward from the left sidewall 120 and the right side wall 122 are posts 124 for engaging the posts 116 of the lower support structure 106. Levers 222 in conjunction with variable locking positions 220 allow the outermost track assemblies 204, and hence the desktop 126, to be locked at any number of positions.

Those having ordinary skill in the relevant art will appreciate the advantages provided by the features of the present disclosure. For example, it is a feature of the present disclosure to provide an exercise apparatus for use in conjunction with an article of furniture. Another feature of the present disclosure is to provide an exercise apparatus that is collapsible to a storage position. It is a further feature of the present disclosure, in accordance with one aspect thereof, to provide a desk with a desktop that may be height adjustable and that may be operated between two positions to thereby reveal a grasping member.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An article of furniture comprising:

an exercise device;

a support structure;

a work surface, said work surface being operable between a first position and a second position; and a grasping member extending from said support structure; and the exercise device having a deck member operable between a storage position and a ready-to-use position, a belt mounted on said deck member, said belt providing a moving exercise surface for a user to exercise in place, a rear roller mechanism comprising a shaft, and a release mechanism for releasing the tension in the belt such that said deck member may be moved from the ready-to-use position to the storage position;

wherein the release mechanism comprises a lever portion pivotally mounted on the shaft of the rear roller mechanism;

wherein said lever portion is selectively moved between a locked position and an unlocked position;

wherein said lever portion abuts a stop in the locked position, thereby locking said shaft in place when the treadmill is in use;

wherein said lever portion is actuated out of contact with the stop in the unlocked position, thereby releasing tension in said belt, such that said shaft and said rear roller mechanism are moveable with respect to the deck member;

wherein said grasping member is accessible for use in conjunction with the exercise device when said work surface is in said first position and is less accessible for use in conjunction with the exercise device when said work surface is in said second position;

wherein, when the exercise device is in an operating position, the grasping member resides directly and vertically beneath at least a portion of the work surface when said work surface is in the second position such that said work surface substantially covers said grasping member and is in vertical alignment with and above said grasping member;

wherein, when the exercise device is in an operating position, the grasping member is substantially exposed and accessible and uncovered when said work surface is in the first position;

wherein said work surface is operable to move from the first position into the second position and from the second position into the first position, to respectively and alternately cover and expose the grasping member, such that said grasping member is substantially covered when the work surface is moved into the second position and substantially exposed and accessible when the work surface is moved into the first position.

2. The article of furniture of claim 1, wherein said work surface is laterally moveable between said first position and said second position, such that said work surface moves solely in a lateral plane from said first position to said second position.

3. The article of furniture of claim 1, wherein said work surface is substantially horizontally oriented in said first position and in said second position.

4. The article of furniture of claim 1, wherein said grasping member is formed from a tubular material.

5. The article of furniture of claim 1, further comprising a pulse rate sensor on said grasping member.

6. The article of furniture of claim 1, wherein said grasping member comprises two gripping locations, one for each hand of a user.

7. The article of furniture of claim 1, wherein said work surface is disposed over a storage location for said exercise device.

8. The article of furniture of claim 1, wherein said exercise device comprises a treadmill.

9. The article of furniture of claim 1, wherein said exercise device is configurable between a ready-to-use position and a storage position.

10. The article of furniture of claim 1, wherein said movement of said work surface from the first position into the second position and from the second position into the first position is confined to movement in a single plane that is substantially horizontal and above the grasping member and the support structure when the exercise device is in an operating position.

11. A treadmill exercise apparatus comprising:

a deck member comprising a front portion and a rear portion, wherein the deck member is operable between a storage position and a ready-to-use position;

a belt mounted on said deck member, said belt providing a moving exercise surface for a user to exercise in place;

a rear roller mechanism comprising a shaft;

a release mechanism for releasing the tension in the belt such that said deck member may be moved from the ready-to-use position to the storage position;

wherein the release mechanism comprises a lever portion pivotally mounted on the shaft of the rear roller mechanism;

wherein said lever portion is selectively moved between a locked position and an unlocked position;

wherein said lever portion abuts a stop in the locked position, thereby locking said shaft in place when the treadmill is in use; and wherein said lever portion is actuated out of contact with the stop in the unlocked position, thereby releasing tension in said belt, such that said shaft and said rear roller mechanism are moveable with respect to the deck member;

an electric motor for moving said deck member between the storage position and the ready-to use position;

an assembly comprising a rod that is attachable to said deck member, a gear attachable to said rod, and a gear wheel that is mounted to an output shaft of said electric motor;

wherein said gear wheel rotatably engages said gear when said electric motor is operable, such that said gear wheel moves with respect to said gear thereby raising said front portion from a horizontal position to a substantially upright position when said electric motor is operable in one direction.

12. The apparatus of claim 11, wherein the front portion and said rear portion of said deck member are joined by a hinge.

13. The apparatus of claim 11, wherein said front portion and said rear portion are at approximately 180 degrees from each other when the deck member is in the ready-to-use position.

14. The apparatus of claim 11, wherein said front portion and said rear portion form an acute angle with each other when the deck member is in the storage position.

15. The apparatus of claim 11, further comprising an electric motor for driving said belt.

16. An article of furniture comprising:

a desk having an upper support structure and a lower support structure, said upper support structure operable between a lowered position and a raised position with respect to said lower support structure;

a work surface mounted on said upper support structure;

at least one electric motor for operating said upper support structure between said lowered position and said raised position;

a deck member operable between a storage position and a ready-to-use position;

a belt mounted on said deck member, said belt providing a moving exercise surface for a user to exercise in place;

a rear roller mechanism comprising a shaft; and a release mechanism for releasing the tension in the belt such that said deck member may be moved from the ready-to-use position to the storage position;

wherein the release mechanism comprises a lever portion pivotally mounted on the shaft of the rear roller mechanism;

wherein said lever portion is selectively moved between a locked position and an unlocked position;

wherein said lever portion abuts a stop in the locked position, thereby locking said shaft in place when the treadmill is in use; and wherein said lever portion is actuated out of contact with the stop in the unlocked position, thereby releasing tension in said belt, such that said shaft and said rear roller mechanism are moveable with respect to the deck member;

wherein a height of said work surface is variable with respect to said lower support structure;

wherein said at least one electric motor operates to move said upper support structure telescopically with respect to said lower support structure to thereby vary the height of said work surface; and wherein said work surface moves laterally with respect to said upper support structure.

17. The article of furniture of claim 16, further comprising an electronic console for controlling said at least one electric motor.

18. The article of furniture of claim 17, wherein said electronic console is pivotally mounted in a recess in the work surface such that said electronic console is operable between a first position and a second position.

19. The article of furniture of claim 18, wherein a surface of said electronic console is substantially flush with said work surface when said electronic console is in said first position.

20. The article of furniture of claim 16, wherein said upper support structure further comprises a grasping member.

21. The article of furniture of claim 20, wherein said work surface is operable between a first position and a second position, wherein said grasping member is accessible for use when said work surface is in said first position and is less accessible for use when said work surface is in said second position.

22. The article of furniture of claim 21, wherein said work surface is laterally moveable between said first position and said second position.

23. The article of furniture of claim 21, wherein said work surface is substantially horizontally oriented in said first position and in said second position.

24. The article of furniture of claim 20, wherein said grasping member is formed from a tubular material.

25. The article of furniture of claim 20, further comprising a pulse rate sensor on said grasping member.

26. The article of furniture of claim 16, wherein said upper support structure comprises at least one power outlet.

27. The article of furniture of claim 16, wherein said at least one electric motor comprises two electric motors.

28. The article of furniture of claim 27, wherein said lower support structure comprises a left sidewall and a right sidewall, each of the left and right sidewalls having one of the two electric motors coupled thereto.

29. The article of furniture of claim 16, wherein said upper support structure is connected to said lower support structure with at least one telescoping member.

30. The article of furniture of claim 16, further comprising an exercise apparatus.

31. The article of furniture of claim 30, wherein said exercise apparatus is a treadmill.

32. The article of furniture of claim 30, wherein said exercise apparatus is operable between a storage position and a ready-to-use position.

33. A treadmill exercise apparatus comprising:

a deck member operable between a storage position and a ready-to-use position;

a belt mounted on said deck member, said belt providing a moving exercise surface for a user to exercise in place;

said deck member comprising foot rails;

a release mechanism for releasing the tension in the belt such that said deck member may be moved from the ready-to-use position to the storage position; and a rear roller mechanism comprising a shaft;

wherein the release mechanism comprises a lever portion pivotally mounted on the shaft of the rear roller mechanism;

wherein said lever portion is selectively moved between a locked position and an unlocked position;

wherein said lever portion abuts a stop in the locked position, thereby locking said shaft in place when the treadmill is in use; and wherein said lever portion is actuated out of contact with the stop in the unlocked position, thereby releasing tension in said belt, such that said shaft and said rear roller mechanism are moveable with respect to the deck member.

34. The apparatus of claim 33, wherein said deck member comprises a front portion and a rear portion joined by a hinge.

35. The apparatus of claim 34, wherein said front portion and said rear portion are at approximately 180 degrees from each other when the deck member is in the ready-to-use position.

36. The apparatus of claim 34, wherein said front portion and said rear portion form an acute angle with each other when the deck member is in the storage position.

37. The apparatus of claim 33, further comprising an electric motor for moving said deck member between the storage position and the ready-to use position.

38. The apparatus of claim 37, further comprising an electronic console for controlling the operation of said electric motor.

39. The apparatus of claim 33, further comprising an article of furniture, said article of furniture having a containment area for the deck member when said deck member is in the storage position.

40. The apparatus of claim 39, wherein said article of furniture comprises a grasping member for use by said user in conjunction with the deck member in the ready-to-use position.

41. The apparatus of claim 40, wherein said article of furniture comprises a work surface operable between a first position and a second position, wherein said grasping member is accessible for use in conjunction when said work surface is in the first position and is less accessible for use in conjunction with the deck member when said work surface is in said second position.

42. The apparatus of claim 41, further comprising an electronic console pivotally mounted in a recess in said work surface.

43. The apparatus of claim 33, wherein said release mechanism comprises a wedge shape.

44. An article of furniture comprising:

a desk portion having an upper support structure and a lower support structure, said upper support structure operable between a lowered position and a raised position with respect to said lower support structure, said upper support structure being connected to said lower support structure with at least one telescoping member;

at least one electric motor for moving said upper support structure between the lowered position and the raised position;

a grasping member coupled to said upper support structure, said grasping member being formed from a tubular material and having a pulse rate sensor thereon;

a work surface mounted on said upper support structure, said work surface operable between a first position and a second position, wherein said grasping member is accessible for use when said work surface is in said first position and is less accessible for use when said work surface is in said second position;

said work surface being substantially horizontally oriented in said first position and in said second position;

a recess formed in said work surface;

an electronic console pivotally mounted in said recess, said electronic console operable between a first position and a second position;

said electronic console having a surface that is substantially flush with said work surface when said electronic console is in said first position;

said electronic console further having a display module for displaying information to a user, a processor module operable between different modes of operation, and at least one manual actuator for selecting between the different modes of operation, wherein at least one of the modes of operation causes said display module to display a countdown of a quantifiable exercise characteristic, said quantifiable exercise characteristic being selected from the group consisting of distance, time, calories burned, and steps taken;

said upper support structure having at least one power outlet for distributing power;

a treadmill portion having a deck member operable between a storage position and a ready-to-use position, said deck member comprising a front portion and a rear portion joined by a hinge, said front portion and said rear portion being approximately 180 degrees from each other when the deck member is in the ready-to-use position, and said front portion and said rear portion forming an acute angle with each other when the deck member is in the storage position;

an electric motor for moving said deck member between the storage position and the ready-to use position;

a gear assembly attached to an output shaft of the electric motor;

a belt mounted on said deck member, said belt providing a moving exercise surface for a user to exercise in place;

a release mechanism for releasing tension in the belt such that said deck member may be operated from the ready-to-use position to the storage position; and a shaft having a roller for the belt mounted thereon, said shaft operable between a first position and a second position, wherein said release mechanism is operable to operate said shaft between said first position and said second position to thereby release tension in said belt.

45. The article of furniture of claim 44, further comprising a rear roller on which the belt rotates;

wherein the release mechanism further comprises a lever portion pivotally mounted on a shaft on which the rear roller for the belt rotates, said lever portion including a cam portion for selectively engaging a stop, said stop being fixedly secured to the deck member;

wherein the release mechanism is configured and arranged such that when it resides in a locked position, the cam is disposed in engagement with the stop to thereby maintain tension in the belt;

wherein the release mechanism is further configured and arranged such that when it resides in a release position, the cam is disposed in disengagement with the stop to thereby permit the shaft and the rear roller to slide in a forward direction;

wherein the release mechanism further comprises a resilient member having one end coupled to the shaft and another end coupled to the deck member, to thereby maintain the release mechanism respectively in the locked and release positions by biasing the cam portion against the stop.

46. A treadmill exercise apparatus comprising:

a deck member operable between a storage position and a ready-to-use position;

a belt mounted on said deck member, said belt providing a moving exercise surface for a user to exercise in place;

a release mechanism for releasing the tension in the belt such that said deck member may be moved from the ready-to-use position to the storage position; and a rear roller on which the belt rotates;

wherein the release mechanism further comprises a lever portion pivotally mounted on a shaft on which the rear roller for the belt rotates, said lever portion including a cam portion for selectively engaging a stop, said stop being fixedly secured to the deck member;

wherein the release mechanism is configured and arranged such that when it resides in a locked position, the cam is disposed in engagement with the stop to thereby maintain tension in the belt;

wherein the release mechanism is further configured and arranged such that when it resides in a release position, the cam is disposed in disengagement with the stop to thereby permit the shaft and the rear roller to slide in a forward direction;

wherein the release mechanism further comprises a resilient member having one end coupled to the shaft and another end coupled to the deck member, to thereby maintain the release mechanism respectively in the locked and release positions by biasing the cam portion against the stop.

47. A treadmill exercise apparatus comprising:

a deck member operable between a storage position and a ready-to-use position;

a belt mounted on said deck member, said belt providing a moving exercise surface for a user to exercise in place;

a rear roller mechanism; and a release mechanism for releasing the tension in the belt such that said deck member may be moved from the ready-to-use position to the storage position;

wherein the release mechanism comprises a lever portion attachable to said rear roller mechanism, wherein the release mechanism further comprises a stop fixedly secured to said deck member;

wherein said lever portion is selectively moved between a locked position and an unlocked position;

wherein said lever portion is in the locked position when said lever portion engages said stop, thereby maintaining a position of said rear roller mechanism when the treadmill is in use; and wherein said lever portion is in the unlocked position when said lever portion disengages the stop, thereby releasing said rear roller mechanism and the tension in said belt.

48. A treadmill exercise apparatus comprising:

a deck member operable between a storage position and a ready-to-use position;

a belt mounted on said deck member, said belt providing a moving exercise surface for a user to exercise in place;

a rear roller mechanism comprising a shaft; and a release mechanism for releasing the tension in the belt such that said deck member may be moved from the ready-to-use position to the storage position;

wherein the release mechanism comprises a lever portion pivotally mounted on the shaft of the rear roller mechanism;

wherein said lever portion is selectively moved between a locked position and an unlocked position;

wherein said lever portion abuts a stop in the locked position, thereby locking said shaft in place when the treadmill is in use; and wherein said lever portion is actuated out of contact with the stop in the unlocked position, thereby releasing tension in said belt, such that said shaft and said rear roller mechanism are moveable with respect to the deck member.

49. The apparatus of claim 48, wherein the rear roller mechanism further comprises a rear roller, wherein said shaft is confined to movement with said rear roller when said lever portion of said release mechanism is actuated out of contact with the stop in the unlocked position.

50. An article of furniture comprising:

an exercise device;

a support structure;

a work surface, said work surface being operable between a first position and a second position;

a grasping member extending from said support structure;

a deck member operable between a storage position and a ready-to-use position;

a belt mounted on said deck member, said belt providing a moving exercise surface for a user to exercise in place;

a rear roller mechanism comprising a shaft; and a release mechanism for releasing the tension in the belt such that said deck member may be moved from the ready-to-use position to the storage position;

wherein the release mechanism comprises a lever portion pivotally mounted on the shaft of the rear roller mechanism;

wherein said lever portion is selectively moved between a locked position and an unlocked position;

wherein said lever portion abuts a stop in the locked position, thereby locking said shaft in place when the treadmill is in use; and wherein said lever portion is actuated out of contact with the stop in the unlocked position, thereby releasing tension in said belt, such that said shaft and said rear roller mechanism are moveable with respect to the deck member;

wherein said grasping member is accessible for use in conjunction with the exercise device when said work surface is in said first position and is less accessible for use in conjunction with the exercise device when said work surface is in said second position;

wherein the work surface is operable to move from the first position into the second position and from the second position into the first position and wherein said movement of said work surface from the first position into the second position and from the second position into the first position is confined to movement in a single plane that is substantially horizontal and above the grasping member and the support structure when the exercise device is in an operating position.

* * * * *